United States Patent [19]

Rüger

[11] Patent Number: 4,596,187

[45] Date of Patent: Jun. 24, 1986

[54] INK METERING DEVICE FOR A PRINTING PRESS

[75] Inventor: Manfred Rüger, Heusenstamm, Fed. Rep. of Germany

[73] Assignee: M.A.N.-ROLAND Druckmaschinen Aktiengesellschaft Patentabtellung, Offenbach am Main, Fed. Rep. of Germany

[21] Appl. No.: 627,930

[22] Filed: Jul. 5, 1984

[30] Foreign Application Priority Data

Jul. 11, 1983 [DE] Fed. Rep. of Germany ..... 3324950

[51] Int. Cl.[4] ..... B41F 31/04; B41F 31/06

[52] U.S. Cl. ..... 101/350; 101/365

[58] Field of Search ..... 101/365, 363, 167, 169, 101/155, 157, 154, 161, 120, 350, 351, 207, 208; 15/256.51, 256.52; 118/203, 261

[56] References Cited

U.S. PATENT DOCUMENTS 2,560,572 7/1951 Haywood et al. ..... 101/350 X 2,641,220 6/1953 Weber et al. ..... 118/261 X 4,211,167 7/1980 Corse ..... 101/363 X 4,387,648 6/1983 Jeschke et al. ..... 101/365

FOREIGN PATENT DOCUMENTS 3225176 3/1983 Fed. Rep. of Germany ..... 101/365

*Primary Examiner*—Charles A. Pearson

*Attorney, Agent, or Firm*—Leydig, Voit & Mayer, Ltd.

[57] ABSTRACT

In this ink metering device, the ink metering elements consist of cylindrical rollers with an edge formed by a recess in their convex surface for removal of the ink. The rollers are mounted with their convex surface in a V-shaped groove of a prismatic rail running parallel with the ink fountain roller and are forced against the wall areas of the groove by a sealing bar flexibly supported on the ink fountain. The distance between the edge and ink fountain roller is varied by turning the rollers by a lever arm. The ink metering device can be adjusted very accurately and is not affected by mechanical stresses and changes in the operating temperature.

8 Claims, 4 Drawing Figures

INK METERING DEVICE FOR A PRINTING PRESS

FIELD OF THE INVENTION

The present invention relates to an ink metering device for a printing press having several ink metering elements movable independently of each other with the spacing of an edge of the elements determining the ink application to an ink fountain roller.

BACKGROUND OF THE INVENTION

In the ink metering device for printing presses disclosed in West German Patent No. 26 29 331 the ink metering elements are designed as side by side slides movable radially to the ink fountain roller. Each slide incorporates a transverse groove in which a camshaft is rotatable by hand or an adjusting motor to change the distance between the slide edge and ink fountain roller. This known ink metering device has generally produced good results in practice. However, if the ink metering has to meet particularly high accuracy requirements, more frequent readjustment of the individual ink slides is necessary to compensate for the effect of changes in operating temperature and other factors such as the hydrodynamic ink pressures at the slide edges.

SUMMARY OF THE INVENTION

The present invention is directed to creating an ink metering device of the above-mentioned type, which can be adjusted with high accuracy without its setting being subject to operating changes and according to the invention, this is accomplished by ink metering elements consisting of cylindrical rollers having an edge formed by a recess in their convex surface parallel with the cylinder axis. The rollers are pivoted in a grooved rail on the machine column at a distance equal to or smaller than the radius of the rollers and with their axis parallel with the ink fountain roller and each roller can be locked in an optionally adjustable angular position.

It has been found that the disadvantages of already known arrangements can be effectively avoided by the separation of the mounting and support of the ink metering elements and the means for their adjustment, as is achieved by the present invention. The mounting arranged near the ink fountain roller and the design of the ink metering elements as rollers permits rugged support thereof to oppose the forces occurring on the rollers with the result that extremely small deformations occur, so that a setting of the ink metering elements is not disadvantageously changed by the loads during operation. Furthermore, the effect of a change in the operating temperature on the set inking gap is almost completely eliminated by the design of the ink metering device according to the invention. An additional feature of the ink metering device according to the invention is its particularly simple and accurate construction since the outside dimensions of the rollers can be achieved with extremely high accuracy by grinding. The subsequent construction of the edge-forming recess does not have to meet such high accuracy requirements, because the position of the edge is determined independently of the recess dimensions by the cylindrical convex surface of the rollers.

A particularly advantageous refinement of the invention is that the rollers are mounted with their cylindrical convex surface disposed in a generally V-shaped groove formed in a prismatic rail parallel with the ink fountain roller and secured to the machine column. The cylindrical elements are held in contact with the groove walls by a counter-bearing arranged opposite the prismatic rail. Particularly simple and rigid support of the rollers is thus achieved and the rollers can be installed and dismantled for maintenance or repair easily after removal of the opposed counter-bearing. The flat wall surfaces of the prismatic rail are preferably arranged at an angle of 90° to each other.

According to a further aspect of the invention, the counter-bearing acts with a defined force on the rollers and consequently the rollers are held in essentially play-free engagement with the prismatic rail without changes in temperature or unfavorable dimensional tolerances being able to lead to jamming of the rollers. The defined force can be suitably generated by springs, hydraulically or by weights and the force of the counter-bearing is preferably so high that the friction contact on the convex surface of the rollers is greater than the torsional forces occurring at their edges when the ink is removed. The rollers are thus held in their set angular position by the support and the forces occurring are absorbed directly by the very rigid support of the rollers and are not transmitted to the adjusting gear.

According to a further proposal of the invention the rollers can carry on the side facing away from the ink fountain roller a lever arm, which can be moved manually or by an adjusting gear acting on its free ends, for adjustment purposes. The lever arm can be secured very easily to an area of the convex surfaces of the rollers not covered by the support and creates an additional transmission system, which increases the setting accuracy. The adjusting gear is preferably connected to a remotely controllable adjusting motor.

To seal the rollers from the ink fountain, according to a further proposal of the invention the counter-bearing can incorporate a sealing bar, which rests against the convex surface of the rollers and a sealing area of the ink fountain and is forced against the rollers by pre-tensioned springs. The sealing bar can advantageously also form the counterbearing.

Also, according to the invention the rollers can be held between ink fountain side plates in such a way that their sides lie close together and provide the required seal to prevent emergence of ink. Relatively good principal dimensions of the ink unit can be achieved for the ink metering device according to the invention, if the diameter of the rollers is between about 3/10 to 5/10 of the diameter of the ink fountain roller. The ink fountain, prismatic rail and adjusting gear can then easily be housed in the usually available installation space.

Further objects, advantages and details of the invention are set forth in the following description of a preferred form of construction as shown in the attached drawings.

DETAILED DESCRIPTION OF THE INVENTION

Figure 1:
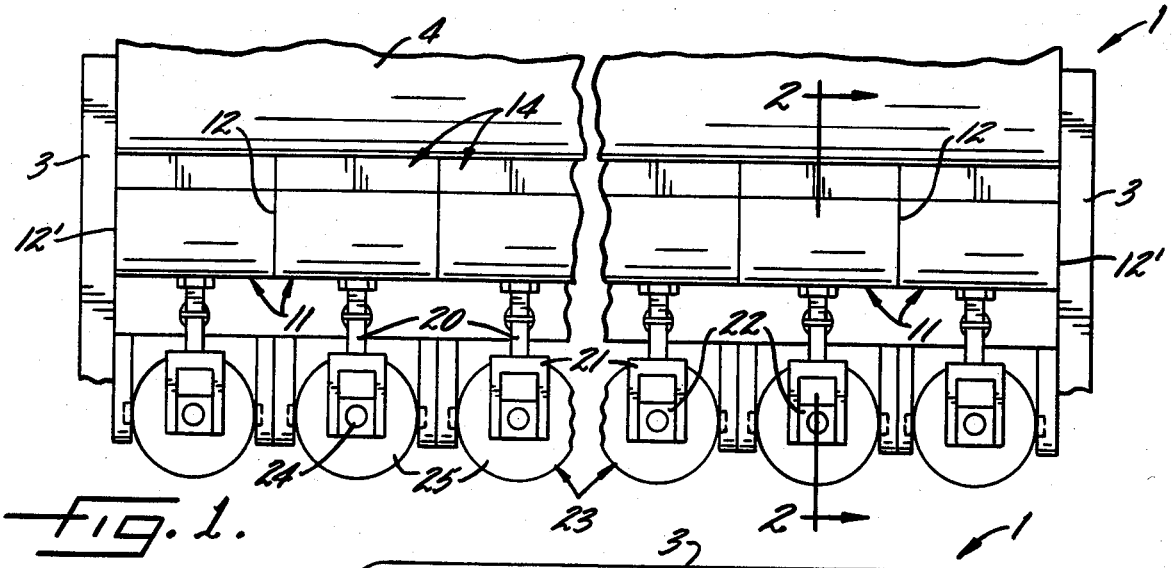
FIG. 1 is a partial plan view of the metering device of the present invention.
Figure 2:
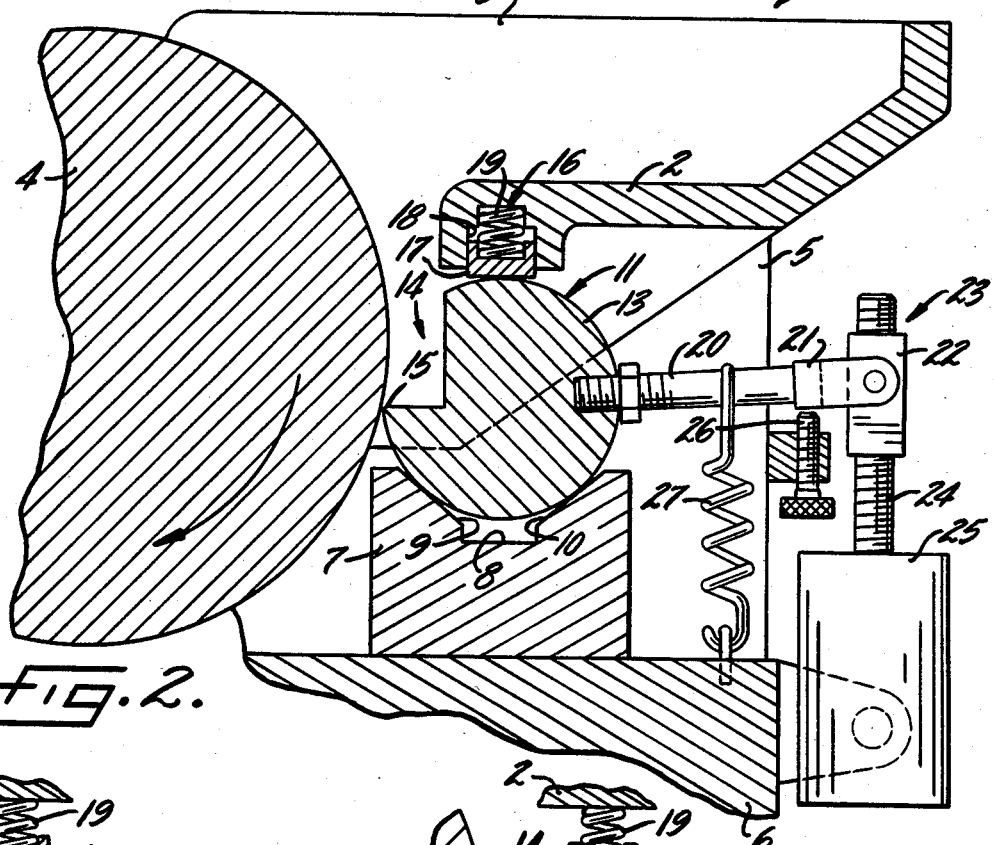
FIG. 2 is an enlarged partial cross-section through the inking unit of FIG. 1.

The inking unit shown in the drawings consists of an ink fountain 1, with a bottom part 2 and side walls 3, which rest against an ink fountain roller 4. The ink fountain 1 and ink fountain roller 4 are mounted on the machine column 5 of the printing press. A prismatic rail 7 having a V-shaped groove 8, with flat ground wall areas 9, 10 roughly at an angle of 90° to each other on their top side facing the ink fountain 1, is secured under the ink fountain 1 on a cross-beam 6 of the machine column 5. The prismatic rail 7 is aligned exactly parallel with the ink fountain roller 4.

Cylindrical rollers 11 lying against each other with plane-parallel end faces 12 rest on the wall areas 9, 10. The two outer rollers 11 lie with their outer side faces 12' on the side walls 3 of the ink fountain 1. In their cylindrical convex surfaces 13, the rollers 11 have a recess 14 forming an edge 15, which meters the ink application to the ink fountain roller 4. To keep the rollers 11 in contact with the wall areas 9, 10, the bottom part 2 of the fountain 1 has a counter-bearing 6 with a sealing bar 17, which extends between the side walls 3 and is guided in a groove 18 in the bottom part 2. The sealing bar 17 is forced against the convex surfaces 13 of the rollers 11 by compression springs 19 supported on the bottom part 2. Preferably, the pre-tensioning of the compression springs 19 is to great that the rollers 11 cannot be turned by the forces occurring at their edges 15.

It will be recognized that the size of the gap which determines the ink metering between the edges 15 and ink fountain roller 4 is adjusted by turning the rollers 11. For this purpose a lever arm 20 carrying at its free end a fork head 21, which is flexibly connected to a nut 22 of an adjusting gear 23, is provided on the rollers 11 on their side facing away from the ink fountain roller 4. The nut 22 is screwed on to a threaded spindle 24, which can be driven in both directions of rotation by an adjusting motor 25. The adjusting motor 25 is hinged on the cross-beam 6.

The ink metering elements of the ink metering device formed by the rollers 11 can be adjusted individually by control of the adjusting motor 25. Although the friction on the wall areas 9, 10 and sealing bar 17 has to be overcome during adjustment, the adjusting forces applied by the adjusting gear 23 are substantially smaller, as a result of the length of the lever arm 20, than the friction forces on the convex surface 13 of the rollers 11. Hence the shear and compressive forces to be absorbed at the edge 15 may also exceed the adjusting forces without loading the adjusting gear.

Figure 3:
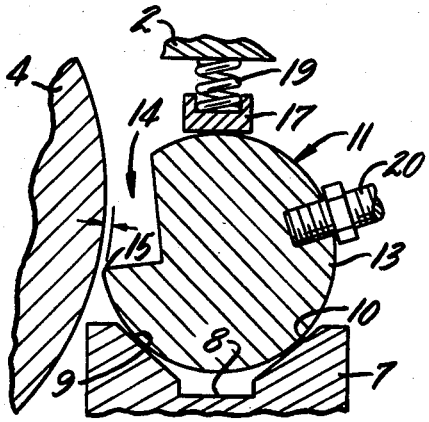
FIGS. 3 and 4 are fragmentary cross-sections of the roller metering element in alternate positions.
Figure 4:
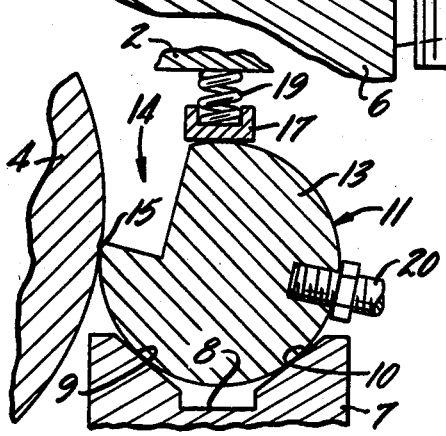

It will be noted that the distance of the rollers 11 from the ink fountain roller 4 is smaller than the diameter of the rollers. Hence the ink fountain roller 4 dips slightly into the recess 14 of the rollers 11, if it is imagined that the cylinder convex surface forms the outer limit of the recess. Hence by moving the nut 22 towards the adjusting motor 25 the edge 15 of the rollers 11 can be brought into contact with the surface of the ink fountain roller 4 (See FIG. 4). The rollers 11 can also be turned back from this normal position until the required inking gap is achieved (See FIG. 3). The swivelling movement of the lever arm 20 can be limited by an adjustable stop 26 in such a way that a minimum gap remains between the edge 15 and ink fountain roller 4 to prevent damage to the ink fountain roller 4 by the edge 15. A tension spring 27 attached to the lever arm 20 and cross-beam 6 keeps the adjusting drive free of play.

The rollers 11 and the prismatic rail 7 can be manufactured with high precision by conventional grinding methods in order to determine their exact operating position. The recess 14 is preferably made after the circular and surface grinding of the rollers. It is only important that the area of the recess 14 forming the edge 15 is parallel with the cylinder axis. Of course, the edge 15 can also be formed by a separate component secured in the recess 14. During assembly the prismatic rail 7 is aligned, exactly parallel with the inking fountain roller 4, e.g., with the aid of rollers with a smaller diameter. After subsequent installation the rollers 11 should be adjusted only by rotation.

An important advantage of the ink metering device described is the high rigidity and precision manufacture of its components. The rollers 11 and also the prismatic rail 7 are subject to hardly any deformations by mechanical stressing during operation. Furthermore mounting of the rollers near the ink fountain roller prevents perceptible thermal deformations. Hence once ink profiles have been set they are maintained with high accuracy over long operating times. For this reason the settings can also be stored and repeatedly set without the need for time-consuming re-adjustment.

I claim as my invention:

1. An ink metering device for an inking unit of a printing press having a supporting machine column, comprising, in combination, a plurality of ink metering elements movable independently of each other for determining the ink application to the surface of an ink fountain roller and wherein the ink metering elements consist of cylindrical rollers each having an edge formed by a recess in their convex surface running parallel with the cylinder axis thereof, a prismatic rail mounted parallel with the ink fountain roller on the machine column and defining a groove with outwardly facing wall areas, the rollers being pivotally mounted with the cylindrical surfaces thereof supported by the wall areas of the groove in the prismatic rail and the rollers being located such that the spacing from their cylindrical axis to the surface of the ink fountain roller is not more than the radius of the rollers, and the distance of the edge formed in the rollers from the surface of the fountain roller being variable by pivotally moving the rollers in the groove of the prismatic rail, a counter bearing sealing bar engaging the surface of said metering rollers for urging said cylindrical metering rollers against the wall areas of the groove in said prismatic rail, and means for locking each roller in an optionally adjustable angular position.

2. An ink metering device according to claim 1 wherein the flat wall areas of the prismatic rail are substantially at an angle of 90° to each other.

3. An ink metering device according to claim 1 wherein the counter-bearing sealing bar acts with a defined force on the rollers and the force of the counter-bearing is such that the frictional contact on the convex surface of the rollers is greater than the turning force occurring at their edges when ink is removed.

4. An ink metering device according to claim 1 wherein said counter-bearing sealing bar rests against the convex surface of the metering rollers and a sealing area of the ink fountain and is forced against the metering rollers by pre-tensioned springs.

5. An ink metering device according to claim 1 wherein the rollers carry a lever arm projecting from the cylindrical surface thereof opposite the ink fountain roller and an adjusting gear acts on the free end of the lever arm for adjustment of the rollers.

6. An ink metering device according to claim 5 wherein the adjusting gear is coupled to a remotely controllable adjusting motor.

7. An ink metering device according to claim 1 wherein the rollers are held between side plates of the ink fountain and the rollers are disposed in end-to-end relationship with the ends of adjacent rollers close to each other.

8. An ink metering device according to claim 1 wherein the diameter of the rollers is between about 3/10 to about 5/10 of the diameter of the ink fountain roller.

* * * * *